US007402025B2

(12) United States Patent
Wang

(10) Patent No.: US 7,402,025 B2
(45) Date of Patent: Jul. 22, 2008

(54) FAN BLADE ASSEMBLY

(76) Inventor: Cliff Wang, No. 122, Teh-Gi Street, South District, Taichung (TW)

( * ) Notice: Subject to any disclaimer, the term of this patent is extended or adjusted under 35 U.S.C. 154(b) by 481 days.

(21) Appl. No.: 11/143,305

(22) Filed: Jun. 2, 2005

(65) Prior Publication Data

US 2006/0275128 A1 Dec. 7, 2006

(51) Int. Cl.
*F04D 29/34* (2006.01)

(52) U.S. Cl. ..... 416/62; 416/210 R; 416/214 R; 416/220 A; 416/222; 416/227 R

(58) Field of Classification Search ..... 416/5, 416/62, 132 A, 204 R, 207, 210 R, 214 R, 416/220 A, 222, 227 R, 227 A
See application file for complete search history.

(56) References Cited

U.S. PATENT DOCUMENTS 925,031 A * 6/1909 Russel ..... 416/204 R
4,621,977 A * 11/1986 Markwardt ..... 416/5
5,516,264 A * 5/1996 Anetrini ..... 416/62
6,419,451 B1 7/2002 Moody et al.
7,101,153 B2 * 9/2006 Cartwright ..... 416/62
2002/0094273 A1 * 7/2002 Huang ..... 416/210 R

* cited by examiner

*Primary Examiner*—Christopher Verdier
(74) *Attorney, Agent, or Firm*—Parsons & Goltry; Michael W. Goltry; Robert A. Parsons

(57) ABSTRACT

A fan blade assembly includes a fan blade and a blade iron. The proximal end of the blade iron is configured for securement to a conventional, commercially available fan motor. An openwork defines the perimeter of the fan blade. A decorative cover spans and is secured to the openwork. The distal end of the blade iron includes a fixture for detachably receiving and holding the proximal end of the openwork.

12 Claims, 8 Drawing Sheets

FAN BLADE ASSEMBLY

BACKGROUND OF THE INVENTION

1. Field of the Invention

The present invention relates to fans.

More particularly, this invention relates to fans of the type commonly employed to circulate air.

In a further and more specific aspect, the instant invention concerns a fan blade assembly especially adapted for use in connection with conventional fans having a motor and a hub rotatably driven the motor.

2. The Prior Art

The prior art is replete with fans of the type commonly employed to circulate air within a residence, a restaurant, an office or other structure. Typically, such fans include a motor which rotatably drives a hub and a plurality of spaced apart fan blade assemblies extending radially from the hub. Each fan blade assembly includes a fan blade and a standardized blade iron having a proximal end secured to the hub and a distal end supporting the proximal end of the fan blade.

Fan blades are conventionally fabricated of a rigid material such as wood or metal. The distal end of the blade iron includes an abutment surface and a plurality of bores extending there through. Corresponding bores extend through the proximal end of the fan blade. The proximal end of the fan blade resides against the abutment surface of the blade iron and screws or other fastening means extend through the corresponding bores to secure the fan blade to the blade iron.

More recently, the prior has provided aesthetically enhanced fan blades. Such fan blades may be constructed of various materials such as cloth, canvas, woven wicker or natural leaf. Due to the flexible nature of these types of blade materials, a frame is required. The frames provided by the prior tend to be unduly complex and expensive to manufacture.

It would be highly advantageous, therefore, to correct the foregoing and other deficiencies inherent in the prior art.

SUMMARY OF THE INVENTION

The above problems inherent in the prior art are at least partially solved and the objects of the present invention are achieved, with a fan blade assembly including a blade iron having a proximal end and a distal end and a fan blade having a proximal end and a distal end. In accordance with the principles of the instant invention, there is provided an openwork carried by one of the proximal end of the fan blade and the distal end of the blade iron. Next provided is a fixture having a receiving area for receiving the openwork and carried by the other of the proximal end of the fan blade and the distal end of the blade iron. Also provided is a retention member carried by the fixture for detachably securing the openwork to the receiving area.

In accordance with the principles of the instant invention the receiving area may be in the form of a recess for matingly receiving the openwork. The retention member is a plate overlying the receiving area and detachably engaged with the fixture. In order for the fan blade to engage air and direct the flow, the distal end of the blade iron is preferably angularly disposed to the proximal end.

It is within the scope of the present invention that the openwork generally define the perimeter of the blade iron. In accordance with a preferred embodiment, the openwork includes a first longitudinal member and second longitudinal members. A proximal member and a distal member conjoin respective ends of the longitudinal members. For purposes of aesthetics, the distal member may be convex relative the longitudinal members.

To prevent warping and twisting when in use, the openwork may include a first reinforcing member extending longitudinally intermediate the longitudinal members and conjoining the proximal end member and the distal end member. Also provided is a second reinforcing member extending laterally of the openwork and conjoining the first longitudinal member and the second longitudinal member.

In accordance with the principles of this invention, a cover spans the openwork. It is contemplated that the cover is decoratively arranged. Also, within the scope of the invention, the cover is detachably secured to the openwork.

Within the purview of the invention, the openwork is integral with the proximal end of the fan blade and the fixture is integral with the distal end of the blade iron. Alternately, the openwork is integral with the distal end of the blade iron and the fixture is integral with the proximal end of the fan blade.

BRIEF DESCRIPTION OF THE DRAWINGS

The objects and advantages of the present invention will become readily apparent to those skill in the art from the following detailed description of preferred embodiments thereof, taken in conjunction with the drawings, in which.

DETAILED DESCRIPTION OF A PREFERRED EMBODIMENT

Figure 1:
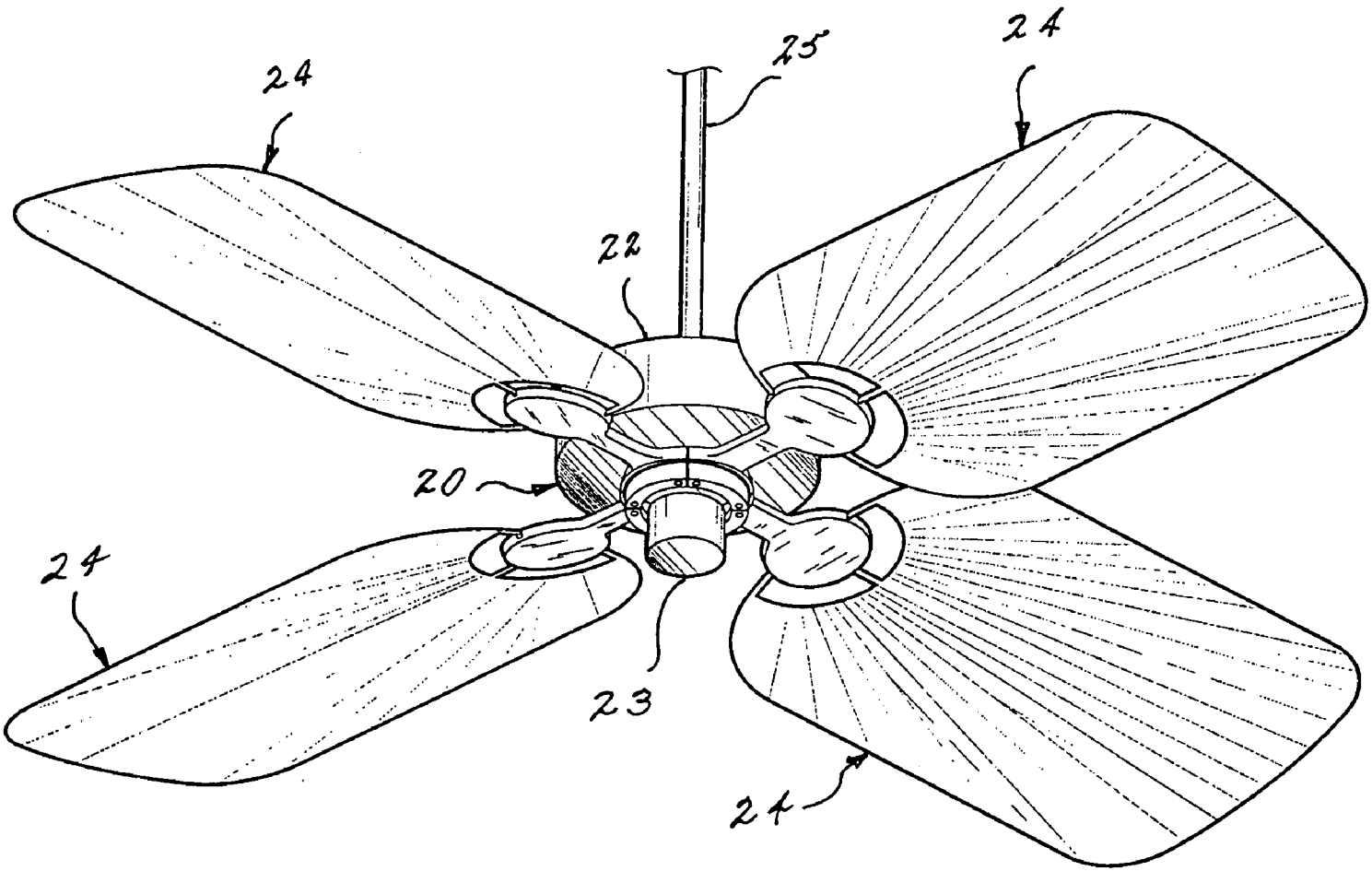
FIG. 1 is a perspective view of a fan incorporating the fan blade assembly constructed in accordance with the teachings of the instant invention.

Turning now to the drawings, in which like reference characters indicate corresponding elements throughout the several views, attention is first directed to FIG. 1 in which there is seen a fan, generally designated by the reference character 20, including motor 22 and hub 23 which is rotated by motor 22. A plurality of blade assemblies 24, fabricated in accordance with the teachings of the instant invention, are engaged with hub 23.

Chosen for purposes of illustration herein is a horizontal fan of the type commonly referred to as a ceiling fan. Motor 22 and hub 23, which are conventional commercially available mechanisms, are suspended from a selected surface by means of shaft 25. It is within the purview of the present invention that fan blade assemblies 24 are useful in connection with vertical fans and with other configurations of fans. It will also be appreciated that while the configuration chosen for purposes of illustration includes four fan blade assemblies, fans having more or having less blades assemblies are well known.

Figure 2:
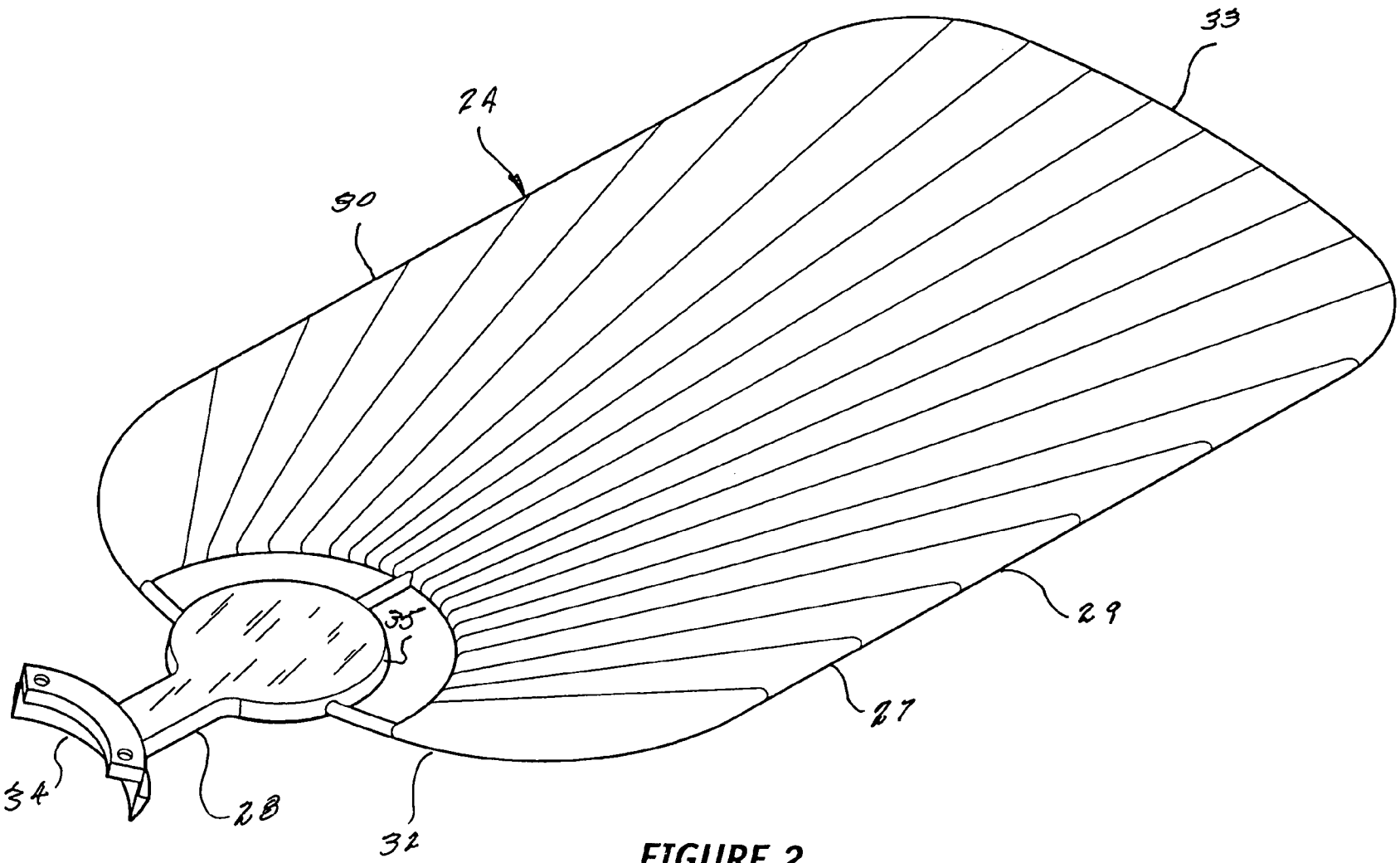
FIG. 2 is an enlarged perspective view of a fan blade assembly as seen in FIG. 1, and especially showing the underside.

Fan blade assembly 24, as further illustrated in FIG. 2, includes fan blade 27 and blade iron 28. Fan blade 27 is defined by first and second spaced apart longitudinal edges, 29 and 30, respectively, proximal end 32 and distal end 33. Blade iron 28 includes proximal end 34 and distal end 35. Blade iron 28 and the interconnection between fan blade 27 and blade iron 28 will be described in detail presently.

Figure 5:
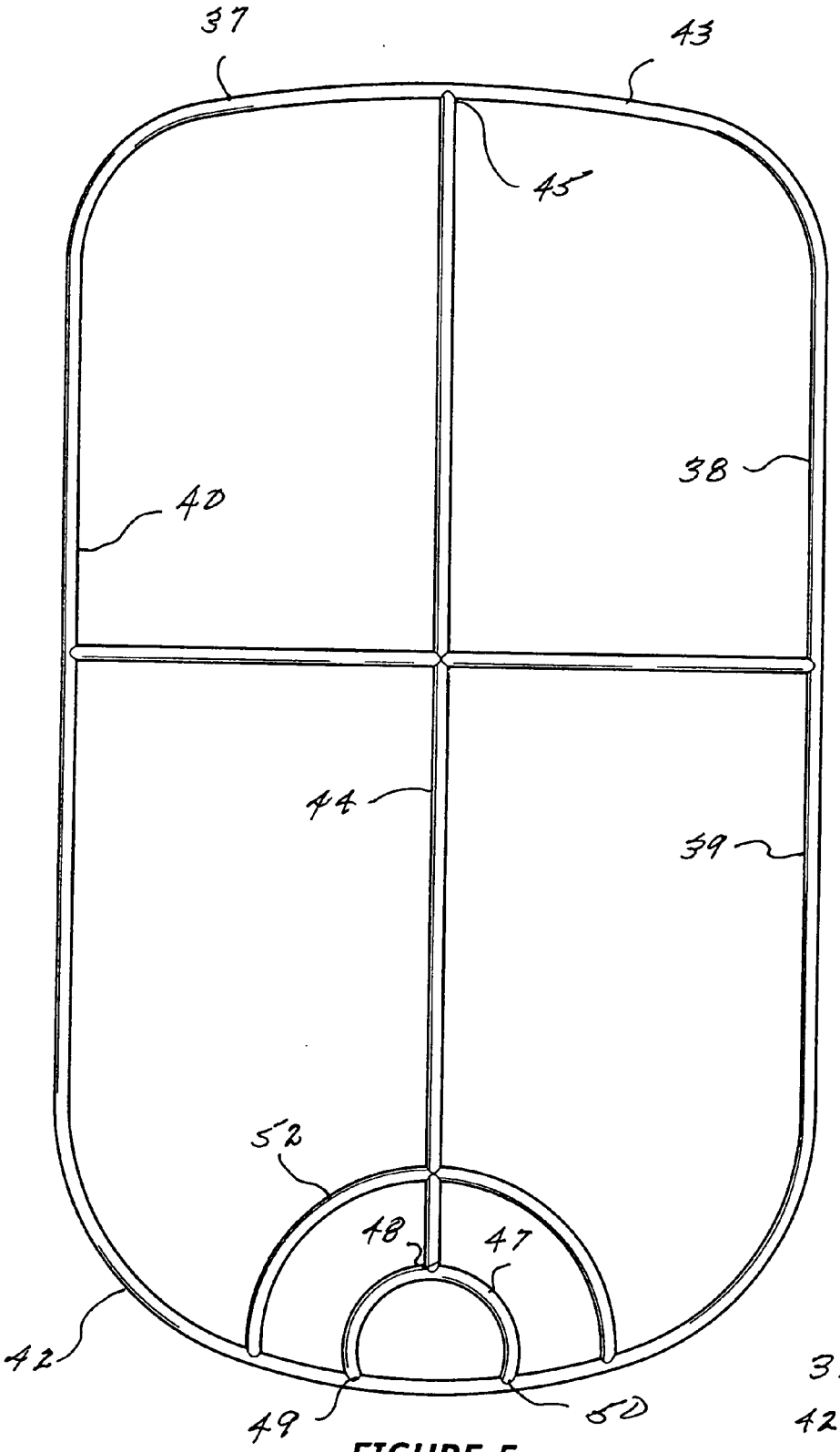
FIG. 5 is a top plan view of an openwork used in connection with the present fan blade assembly.
Figure 6:
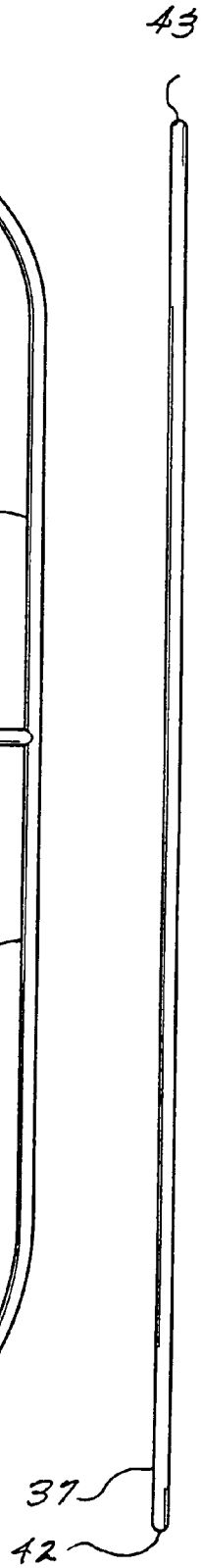
FIG. 6 is a side elevation view of the openwork seen in FIG. 5.

Fan blade 27 incorporates openwork 37 as viewed in FIGS. 5 and 6. Openwork 37 includes a parametric member 38 having longitudinal member 39, longitudinal member 40, proximal member 42 and distal member 43. Preferably, parametric member 38 is integrally fabricated of metallic rod. For purposes of aesthetics, it is preferred that proximal member 42 and distal members 43 are convex, that is, arched outwardly relative the configuration defined by parametric member 38.

A first reinforcing member 44 extends longitudinally of parametric member 38 intermediate longitudinal members 39 and 40. The distal end 45 of first reinforcing member 44 conjoins distal member 43 at an intermediate location. Concave arcuate member 47 is secured to the proximal end 48 of reinforcing member 44 and includes ends 49 and 50 which are conjoined with distal member 43 at spaced apart locations. Also provided is a second arcuate member 52, generally concentric with first arcuate member 47 and conjoining first reinforcing member 44 and proximal member 42. The purposes of first and second arcuate members 47 and 52, respectively, will become apparent as the description ensues.

Figure 7:
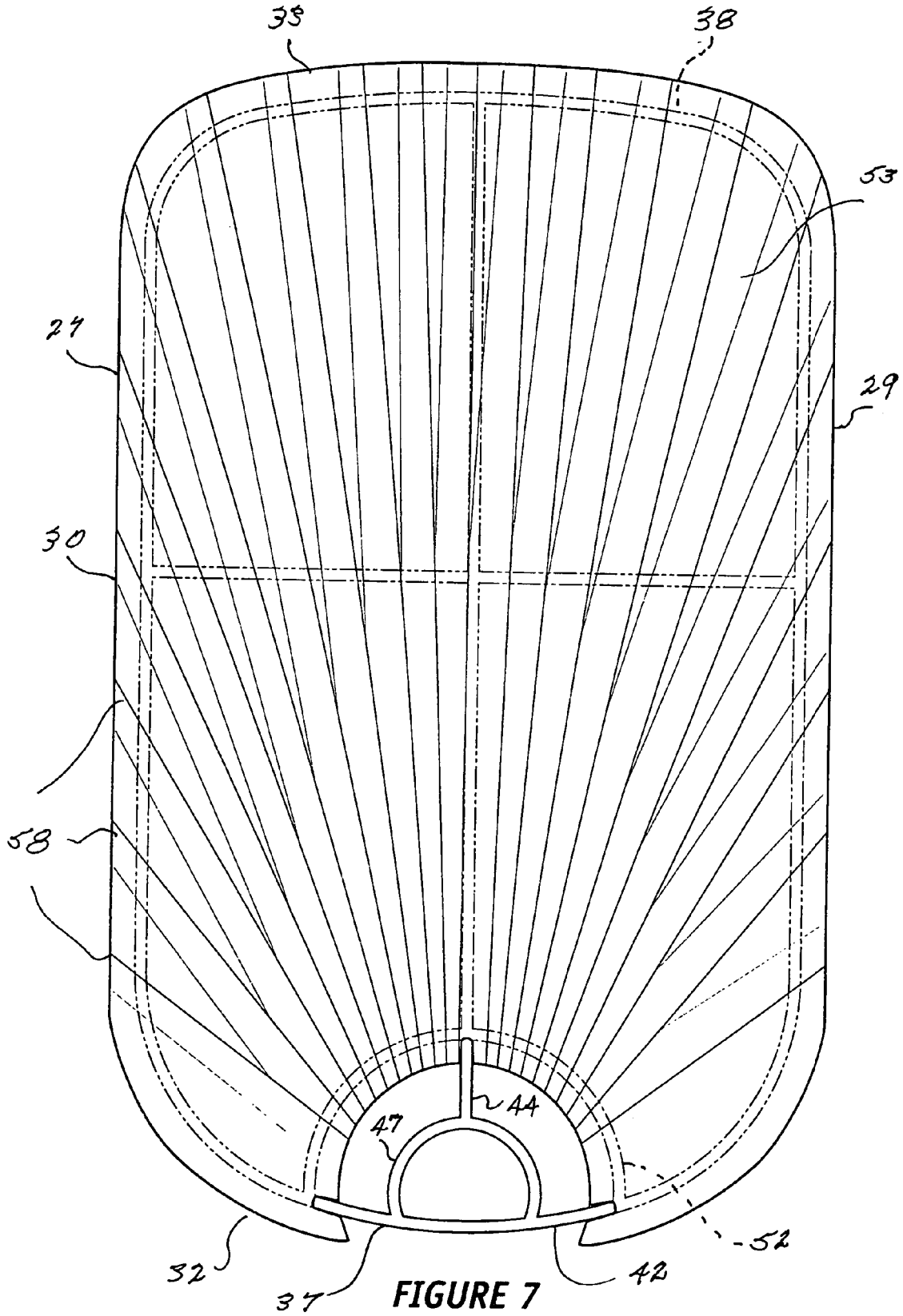
FIG. 7 is a bottom plan view of the openwork seen in FIG. 5 as it would appear when overlaid with a cover.
Figure 8:
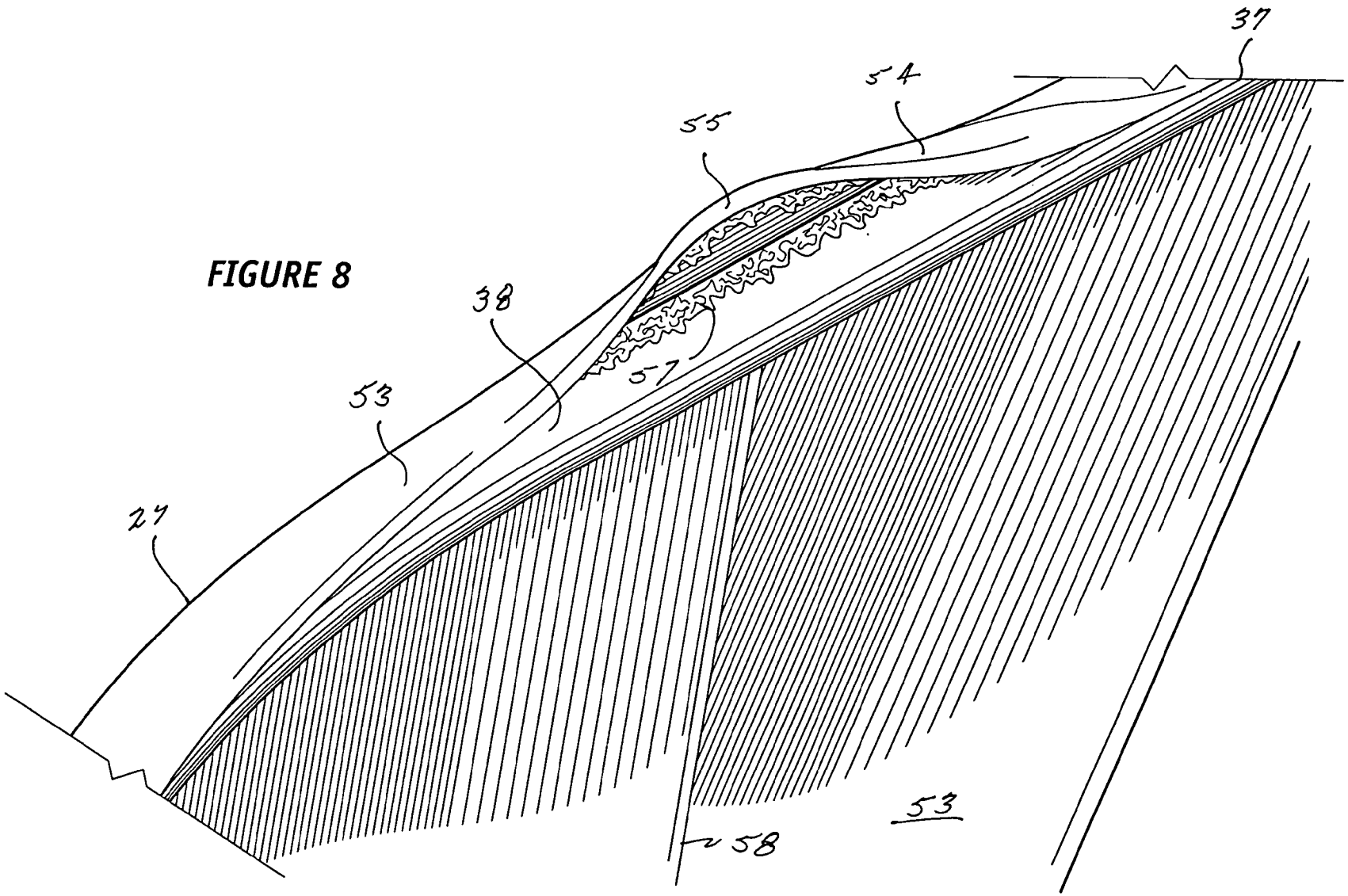
FIG. 8 is an enlarged perspective view of a fragmentary portion of the blade assembly seen in FIG. 7.

Turning now to FIG. 7, there is seen a cover 53 spanning and overlying a portion of openwork 37. With additional reference to FIG. 8, it is seen that cover 53 includes a parametric terminal portion 54 adjacent parametric edge 55 that is wrapped about openwork 37 and secured thereto as by adhesive 57. More specifically, cover 53 is affixed to longitudinal member 39, longitudinal member 40 and distal member 43. Cover 53 is also bonded to second arcuate member 52 and the portions of proximal member 42 outside the central section defined by second arcuate member 52.

Preferably, cover 53 is fabricated of a flexible material such as cloth or plastic sheet. For purposes of aesthetics, it is within the scope of the present invention that cover 53 be decoratively enhanced. As illustrated, cover 53 incorporates a plurality of pleats 58. Other decorative enhancements, such as colorful imprinting and alternate folding will readily occur to those skilled in the art.

It is within the scope of this invention that cover 53 may be removable and replaceable. Most conventional bonding materials dissolve in the presence of a corresponding distilling agent.

Figure 9:
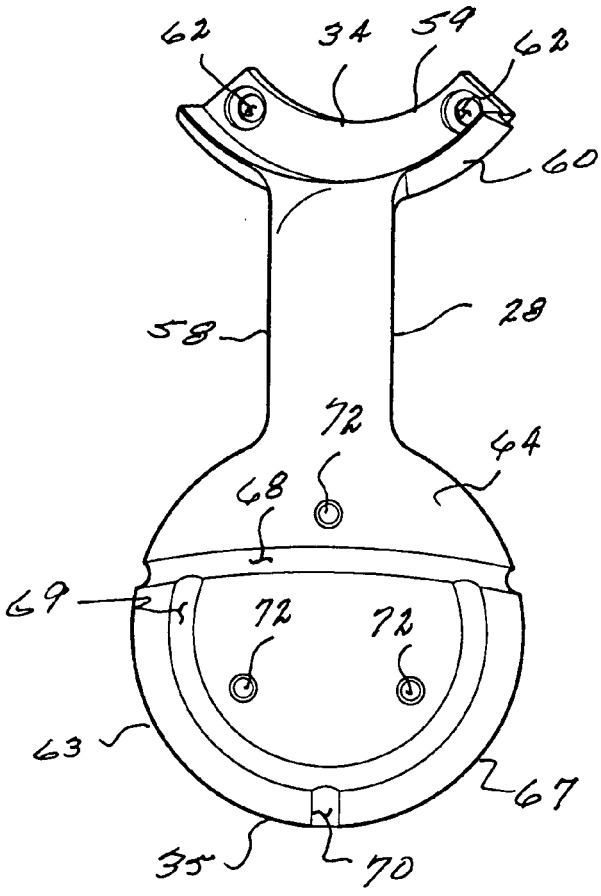
FIG. 9 is a top plan view of a blade iron constructed in accordance with the teachings of the present invention.
Figure 10:
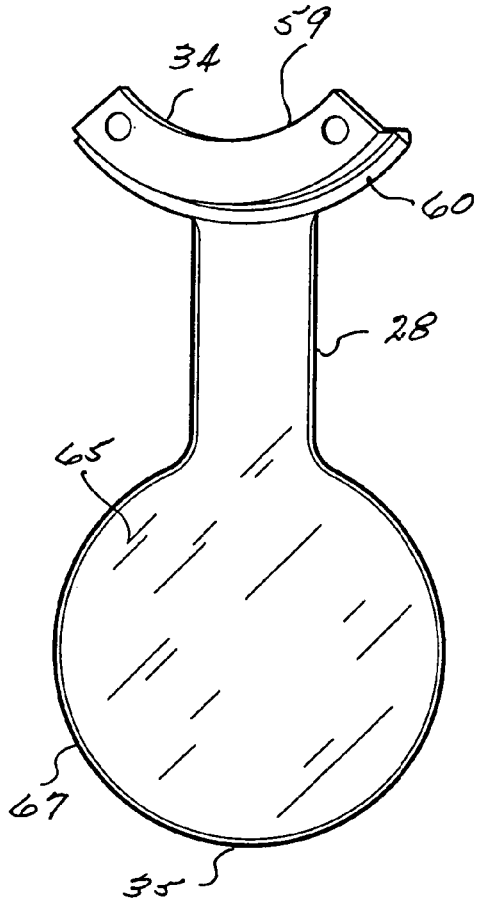
FIG. 10 is a bottom plan view of the blade iron seen in FIG. 9.

In accordance with a preferred embodiment of the invention, blade iron 28, as illustrated in FIGS. 9 and 10, includes shank 58 intermediate proximal end 34 and distal end 35. Proximal end 34, as herein chosen for purposes of illustration, includes arcuate mounting member 59 and flange 60. Openings 62 accommodate screws which are threadably engaged within hub 23 to secure the proximal end 34 of blade iron 28 to hub 23. Proximal end 34, as described in detail above, will mount to a hub of a common, commercially available fan. Other configurations of proximal end 34 usable with other commercially available fans will be readily appreciated by those skilled in the art.

Distal end 35 of blade iron 28 includes pad 63 having top surface 64, bottom surface 65 and peripheral edge 67. Pad 63, as herein chosen for purposes of illustration, is in the form of a circular disk. For purposes of aesthetics, pad 63 may assume various forms such as multisided or free form. The physical form of pad 63 has no relevance to the instant invention.

Figure 11:
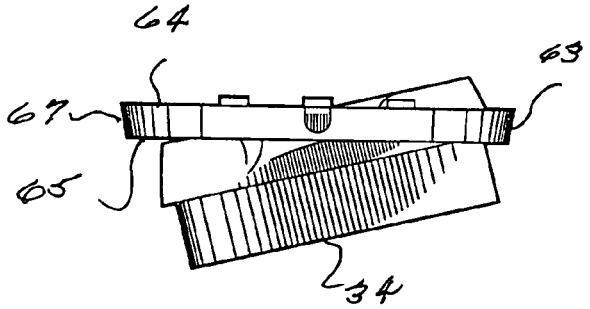
FIG. 11 is a distal end view of the blade iron.

A substantially transverse, slightly arcuate recess 68, a substantially circular recess 69 which is concentric with peripheral edge 67 and a radial recess 70 are formed into the top surface 64 of pad 63. A plurality of spaced apart threaded bores 72 are also formed into the top surface 64 of pad 63. Accordingly, pad 63, as seen with further reference to FIG. 11, has sufficient thickness to accommodate several threads. Pad 63 functions as a fixture for attachment of previously described fan blade 27.

Figure 12:
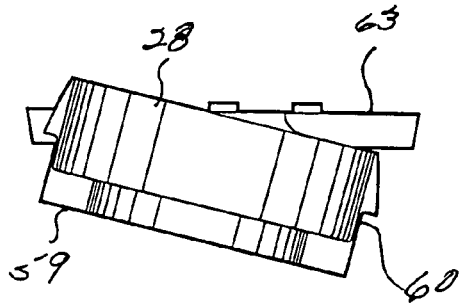
FIG. 12 is a proximal end view of the blade iron.
Figure 13:
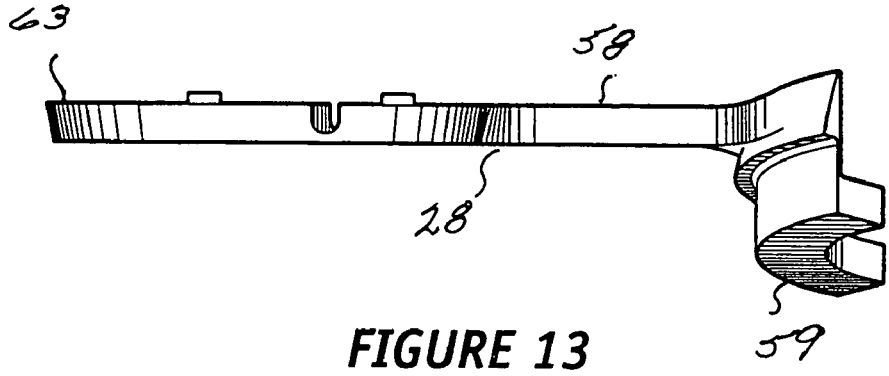
FIG. 13 is a side elevation view of the blade iron.
Figure 14:
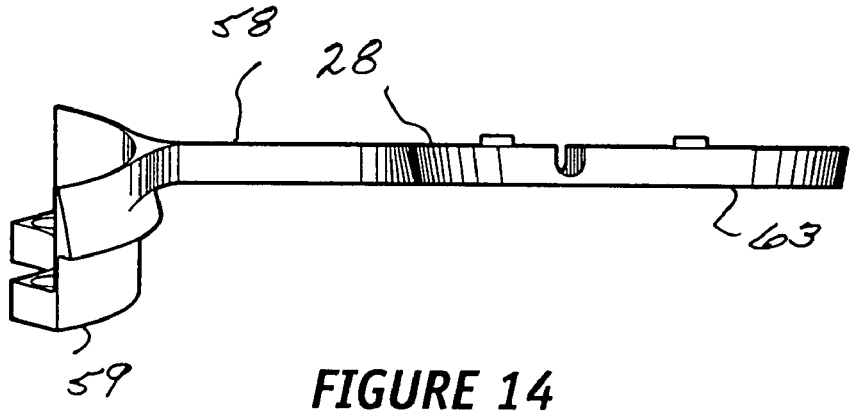
FIG. 14 is a side elevation view of the blade iron, especially showing the side opposite the side seen in FIG. 13.

As seen with reference to FIGS. 12, 13 and 14, distal end 35 of blade iron 28 is angularly disposed to proximal end 34 of blade iron. That is, mounting member 59 lies in a plane that is angularly displaced from the plane of pad 63.

Figure 15:
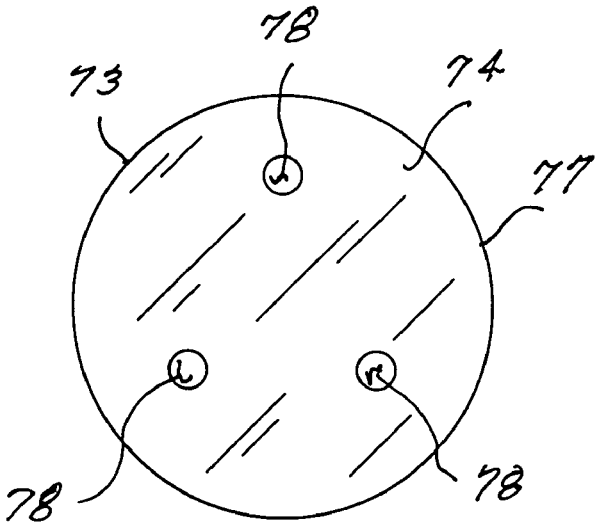
FIG. 15 is a top plan view of a retention member used in connection the blade iron.
Figure 16:
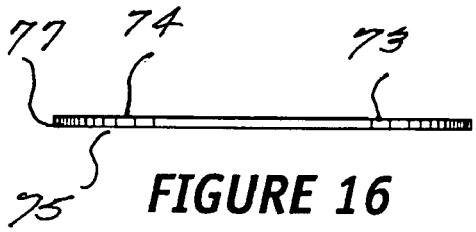
FIG. 16 is an elevation view of the retention member seen in FIG. 15.

FIGS. 15 and 16 illustrate a disk 73 having top surface 74, bottom surface 75 and peripheral edge 77. Preferably, peripheral edge 77 is concentric with peripheral edge 67 of pad 63. Openings 78, extending through disk 73, align with the threaded bores 72 formed into pad 63.

Figures 3, 4:
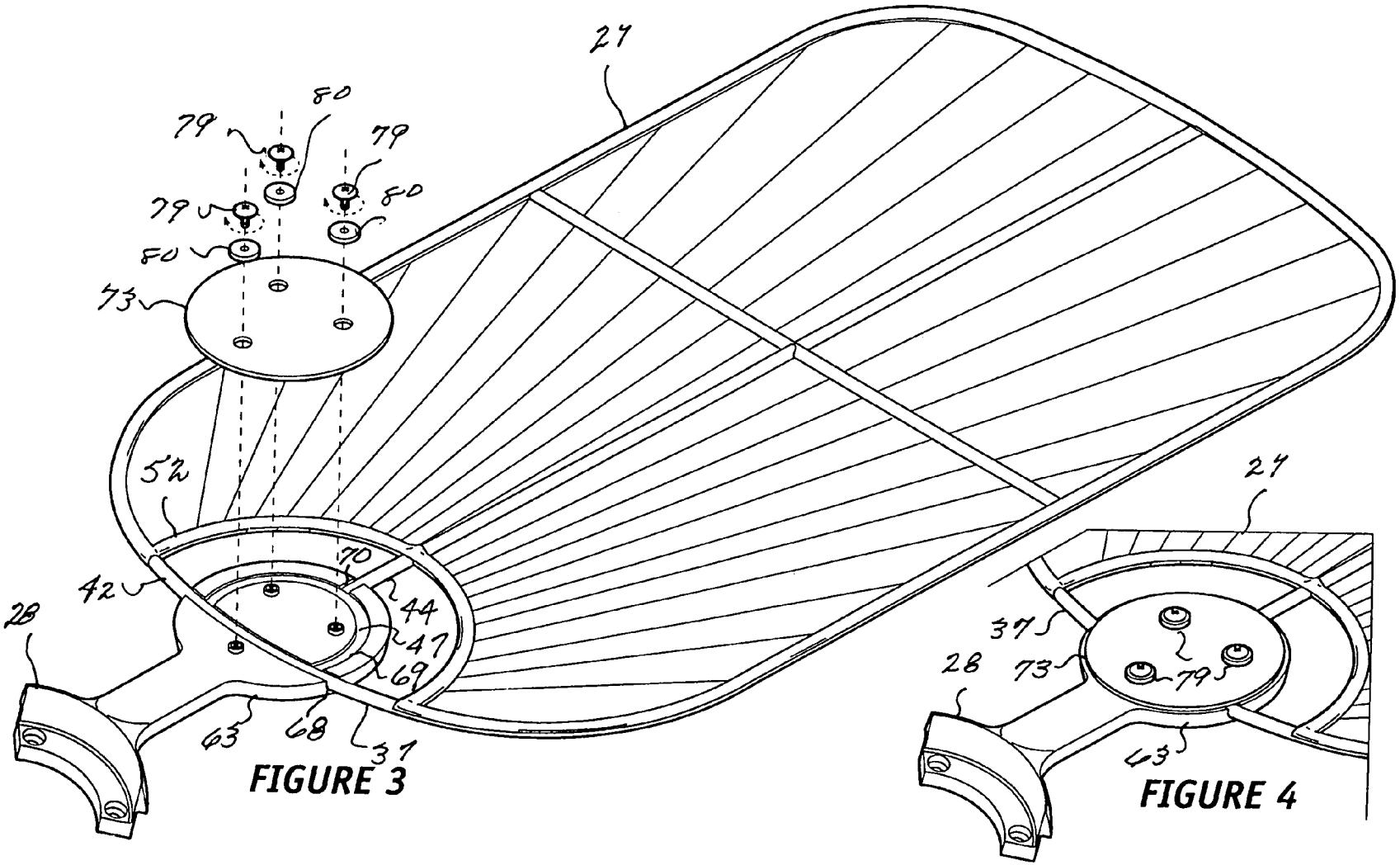
FIG. 3 is an exploded perspective view of the fan blades assembly seen in FIG. 2, and especially showing the top side.
FIG. 4 is a fragmentary perspective view of the fan blade assembly seen in FIG. 3.

Attention is now directed to FIG. 3, in which it is seen that pad 63 carried by blade iron 28 functions as a fixture for supporting blade 27. The several recesses formed into pad 63 function as a receiving area for the proximal end 32 of blade 27. More specifically, proximal member 42 of openwork 37 is matingly received within recess 68. Arcuate member 47 of openwork 37 is matingly received within recess 69. The proximal end of first reinforcing member 44 is matingly received within recess 70.

Disk 73, as illustrated with additional reference to FIG. 4, functions as a retention member for detachably securing openwork 37 to blade iron 28. Disk 73 overlays pad 63, particularly the several recesses and the corresponding members of openwork 37, and is secured thereto by means of screws which extend through the openings 78 and threadably engage within the bores 72. Washers 80 are also used in accordance with conventional practice. The completed assembly of blade iron 28 and fan blade 27 is illustrated in FIG. 4. Preferably convex member 52, to which is secured the proximal end of cover 53, is spaced from and concentric with pad 63.

The present invention is described above with reference to a preferred embodiment. However, those skilled in the art will recognize that changes and modifications may be made in the described embodiment without departing from the nature and scope of the present invention. For instance, disk 73 could be replaced with individual tabs which overlay the members of openwork 37 which reside within the several recesses and secured with screws as described. It is also with the scope of the invention that the openwork be carried by the distal end of the blade iron and that the pad and retention member be carried by the proximal end of the fan blade. Further, it is contemplated that the fan blade can be fabricated in various sizes and aesthetic shapes to satisfy the desires of the user.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. In a fan having a hub mounted for rotation, a fan blade assembly comprising:

a blade iron including a proximal end securable to the hub and a distal end;

a fan blade having a proximal end and an opposing end;

a plurality of elongate members form an openwork carried by one of the proximal end of the fan blade and the distal end of the blade iron;

a fixture carried by the other of the proximal end of the fan blade and the distal end of the blade iron, the fixture comprising a pad having opposed top and bottom faces and a plurality of recesses formed in the top face of the pad corresponding to the elongate members of the openwork;

the elongate members forming the openwork matingly received in the recesses;

a plate concurrently overlies the top face of the pad, the recesses and the elongate members forming the openwork received in the recesses; and the plate secured to the pad securing the elongate members of the openwork in the recesses and, in turn, securing the proximal end of the fan blade to the distal end of the blade iron.

2. The fan blade assembly of claim 1, wherein said plate is detachably engaged with said pad.

3. The fan blade assembly of claim 1, wherein the distal end of said blade iron is angularly disposed relative the proximal end of said blade iron.

4. The fan blade assembly of claim 1, wherein said openwork generally defines the perimeter of said fan blade.

5. The fan blade assembly of claim 4, wherein said openwork includes:

a first longitudinally extending member;

a second longitudinally extending member spaced from said first longitudinally extending member;

a proximal member conjoining said first and said second longitudinal member; and a distal member conjoining said first and said second longitudinal member.

6. The fan blade assembly of claim 5, wherein said distal member is convex relative said first and said second longitudinal member.

7. The fan blade assembly of claim 6, further including a first reinforcing member extending longitudinal of said openwork and conjoining said proximal end member with said distal end member.

8. The fan blade assembly of claim 7, further including a second reinforcing member extending laterally of said openwork and conjoining said first longitudinal member with said second longitudinal member.

9. The fan blade assembly of claim 4, further including a cover spanning said openwork.

10. The fan blade assembly of claim 9, wherein said cover is decoratively arranged.

11. The fan blade assembly of claim 9, wherein said cover is detachably secured to said openwork.

12. The fan blade assembly of claim 1, wherein:

said openwork is integral with the proximal end of said fan blade; and said fixture is integral with the distal end of said blade iron.

* * * * *